United States Patent [19]

Larson

[11] Patent Number: 4,702,985

[45] Date of Patent: Oct. 27, 1987

[54] AMINOALCOHOLS AS ADJUVANT FOR LIQUID ELECTROSTATIC DEVELOPERS

[75] Inventor: James R. Larson, Greenville, Del.

[73] Assignee: E. I. Du Pont de Nemours and Company, Wilmington, Del.

[21] Appl. No.: 856,392

[22] Filed: Apr. 28, 1986

[51] Int. Cl.[4] ..... G03G 9/12

[52] U.S. Cl. ..... 430/115

[58] Field of Search ..... 430/115

[56] References Cited

U.S. PATENT DOCUMENTS

| | | | |
|---|---|---|---|
| 3,362,907 | 1/1968 | Matkan et al. | 430/115 |
| 3,417,019 | 12/1968 | Beyer | 430/115 |
| 3,528,097 | 9/1970 | Otsuka et al. | 430/115 X |
| 3,844,966 | 10/1974 | Nelson | 430/115 |
| 4,144,184 | 3/1979 | Takahata et al. | 430/115 |

FOREIGN PATENT DOCUMENTS

| | | | |
|---|---|---|---|
| 51-109843 | 9/1976 | Japan | 430/115 |
| 54-28141 | 2/1979 | Japan . | |

OTHER PUBLICATIONS

Allen et al., "Improved Electrostatic Printing Inks", Xerox Discl. Jour., vol. 2, No. 6, Nov.-Dec. 1977, pp. 77-80 (copy 156).

*Primary Examiner*—Roland E. Martin

[57] ABSTRACT

Electrostatic liquid developer having improved charging characteristics comprising (A) nonpolar liquid having a Kauri-butanol value of less than 30, present in a major amount, (B) thermoplastic resin particles having an average by area particle size of less than 10 μm, (C) nonpolar liquid soluble ionic or zwitterionic compound, and (D) at least one aminoalcohol compound.

The electrostatic liquid developer is useful in copying, making proofs including digital color proofs, lithographic printing plates, and resists.

16 Claims, 2 Drawing Figures

CONDUCTIVITY OF DEVELOPERS OF EX. 6 DURING MACHINE RUN

AMINOALCOHOLS AS ADJUVANT FOR LIQUID ELECTROSTATIC DEVELOPERS

DESCRIPTION

1. Technical Field

This invention relates to an electrostatic liquid developer having improved charging characteristics. More particularly this invention relates to an electrostatic liquid developer containing as a constituent an aminoalcohol compound.

2. Background Art

It is known that a latent electrostatic image can be developed with toner particles dispersed in an insulating nonpolar liquid. Such dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are known for forming latent electrostatic images. For example, one method is providing a carrier with a dielectric surface and transferring a preformed electrostatic charge to the surface. Useful liquid toners comprise a thermoplastic resin and dispersant nonpolar liquid. Generally a suitable colorant is present such as a dye or pigment. The colored toner particles are dispersed in the nonpolar liquid which generally has a high-volume resistivity in excess of 109 ohm centimeters, a low dielectric constant below 3.0 and a high vapor pressure. The toner particles are less than 10 μm average by area size. After the latent electrostatic image has been formed, the image is developed by the colored toner particles dispersed in said dispersant nonpolar liquid and the image may subsequently be transferred to a carrier sheet.

Since the formation of proper images depends on the differences of the charge between the liquid developer and the latent electrostatic image to be developed, it has been found desirable to add a charge director compound to the liquid toner comprising the thermoplastic resin, dispersant nonpolar liquid and generally a colorant. Such liquid toners, while developing good quality images, still do not provide the quality images required for certain end uses, e.g., optimum machine performance in digital color proofing. As a result much research effort has been expended in providing new type charge directors and/or charging adjuvants for electrostatic liquid toners. Higher quality image development of latent electrostatic images is still desired.

It has been found that the above disadvantages can be overcome and improved electrostatic liquid developers prepared containing an ionic or zwitterionic compound soluble in nonpolar liquid which have stabilized conductivity and/or improved image quality on latent electrostatic images.

BRIEF DESCRIPTION OF THE DRAWING

In the accompanying drawing forming a material part of this disclosure.

DISCLOSURE OF THE INVENTION

Figure 1:
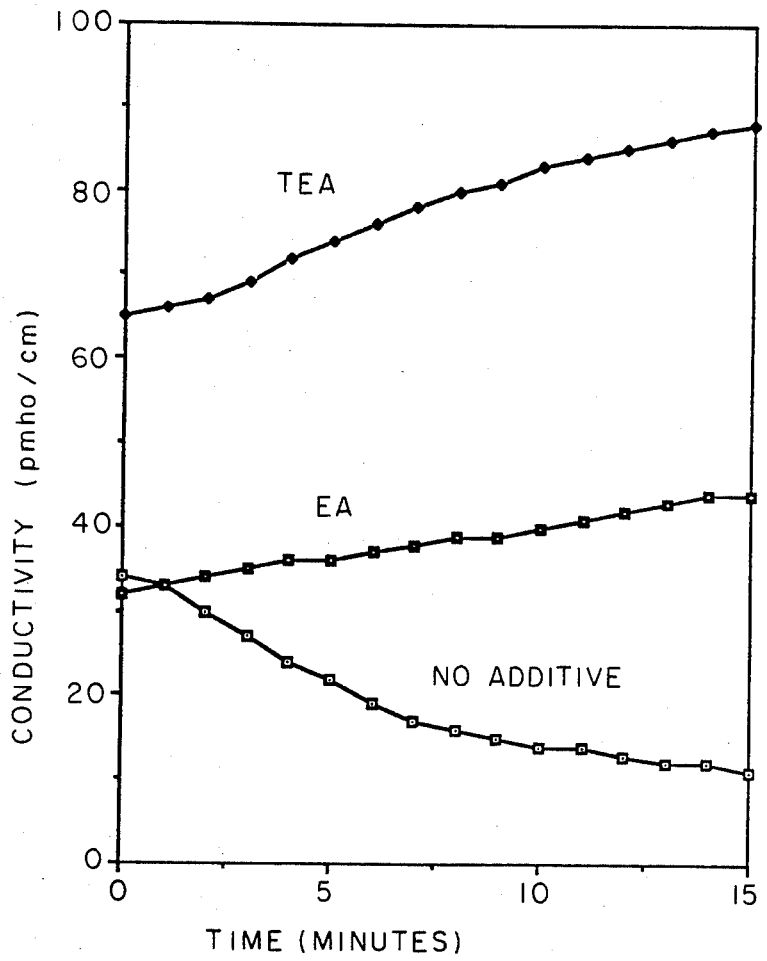
FIG. 1 is a plot of the conductivity (pmho/cm) of a control developer (no additive) and developers of the invention containing triethanol amine (TEA) or ethanolamine (EA) over a time period of 15 minutes.

In accordance with this invention there is provided an electrostatic liquid developer having improved charging characteristics comprising (A) nonpolar liquid having a Kauri-butanol value of less than 30, present in a major amount, (B) thermoplastic resin particles having an average by area particle size of less than 10μm, (C) nonpolar liquid soluble ionic or zwitterionic compound, and (D) at least one aminoalcohol compound.

Throughout the specification the below-listed terms have the following meanings:

Nonpolar liquid soluble ionic or zwitterionic compounds (C) are referred to throughout as charge directors.

Aminoalcohol (D) means that there is both an amino functionality and hydroxyl functionality in one compound.

Conductivity is the conductivity of the developer measured in picomhos (pmho)/cm at 5 hertz and 5 volts.

The electrostatic liquid developer, as defined above comprises four primary components more specifically described below. Additional components, in addition to the four primary components, include but are not limited to: colorants such as pigments or dyes, which are preferably present, fine particle size oxides, metals, etc.

The dispersant nonpolar liquids (A) are, preferably, branched-chain aliphatic hydrocarbons and more particularly, Isopar ®-G, Isopar ®-H, Isopar ®-K, Isopar ®-L, Isopar ®-M and Isopar ®-V. These hydrocarbon liquids are narrow cuts of isoparaffinic hydrocarbon fractions with extremely high levels of purity. For example, the boiling range of Isopar ®-G is between 157° C. and 176° C., Isopar ®-H between 176° C. and 191° C., Isopar ®-K between 177° C. and 197° C., Isopar ®-L between 188° C. and 206° C., Isopar ®-M between 207° C. and 254° C. and Isopar ®-V between 254.4° C. and 329.4° C. Isopar ®-L has a mid-boiling point of approximately 194° C. Isopar ®-M has a flash point of 80° C. and an auto-ignition temperature of 338° C. Stringent manufacturing specifications, such as sulphur, acids, carboxyl, and chlorides are limited to a few parts per million. They are substantially odorless, possessing only a very mild paraffinic odor. They have excellent odor stability and are all manufactured by the Exxon Corporation. High-purity normal paraffinic liquids, Norpar ®12, Norpar ®13 and Norpar ®15, Exxon Corporation, may by used. These hydrocarbon liquids have the following flash points and auto-ignition temperatures:

| Liquid | Flash Point (°C.) | Auto-Ignition Temp (°C.) |
|---|---|---|
| Norpar ® 12 | 69 | 204 |
| Norpar ® 13 | 93 | 210 |
| Norpar ® 15 | 118 | 210 |

All of the dispersant nonpolar liquids have an electrical volume resistivity in excess of $10^9$ ohm centimeters and a dielectric constant below 3.0. The vapor pressures at 25° C. are less than 10 Torr. Isopar ®-G has a flash point, determined by the tag closed cup method, of 40° C., Isopar ®-H has a flash point of 53° C. determined by ASTM D 56. Isopar ®-L and Isopar ®-M have flash points of 61° C., and 80° C., respectively, determined by the same method. While these are the preferred dispersant nonpolar liquids, the essential characteristics of all suitable dispersant nonpolar liquids are the electrical volume resistivity and the dielectric constant. In addition, a feature of the dispersant nonpolar liquids is a low Kauri-butanol value less than 30, preferably in the vicinity of 27 or 28, determined by ASTM D 1133. The ratio of thermoplastic resin to dispersant nonpolar liquid is such that the combination of ingredients becomes fluid at the working temperature.

Useful thermoplastic resins or polymers include: ethylene vinyl acetate (EVA) copolymers (Elvax ®resins, E. I. du Pont de Nemours and Company, Wilmington, DE), copolymers of ethylene and and $\alpha,\beta$-ethylenically unsaturated acid selected from the class consisting of acrylic acid and methacrylic acid, copolymers of ethylene (80 to 99.9%)/acrylic or methacrylic acid (20 tp 0%)/alkyl ($C_1$ to $C_5$) ester of methacrylic or acrylic acid (0 to 20%), polyethylene, polystyrene, isotactic polypropylene (crystalline), ethylene ethyl acrylate series sold under the trademark Bakelite ® DPD 6169, DPDA 6182 Natural and DTDA 9169 Natural by Union Carbide Corp., Stamford, CN; ethylene vinyl acetate resins, e.g., DQDA 6479 Natural and DQDA 6832 Natural 7 also sold by Union Carbide Corp.; Surlyn ® ionomer resin by E. I. du Pont de Nemours and Company, Wilmington DE, etc. Preferred copolymers are the copolymer of ethylene and an $\alpha,\beta$-ethylenically unsaturated acid of either acrylic acid or methacrylic acid. The synthesis of copolymers of this type are described in Rees U.S. Pat. No. 3,264,272, the disclosure of which is incorporated herein by reference. For the purposes of preparing the preferred copolymers, the reaction of the acid containing copolymer with the ionizable metal compound, as described in the Rees patent, is omitted. The ethylene constituent is present in about 80 to 99.9% by weight of the copolymer and the acid component in about 20 to 0.1% by weight of the copolymer. The acid numbers of the copolymers range from 1 to 120, preferably 54 to 90. Acid No. is milligrams potassium hydroxide required to neutralize 1 gram of polymer. The melt index (g/10 min) if 10 to 500 is determined by ASTM D 1238 Procedure A. Particularly preferred copolymers of this type have an acid number of 66 and 60 and a melt index of 100 and 500 determined at 190° C., respectively.

In addition, the resins have the following preferred characteristics:

1. Be able to disperse the colorant, e.g., pigment.
2. Be insoluble in the dispersant liquid at temperatures below 40° C., so that the resin will not dissolve or solvate in storage.
3. Be able to solvate at temperatures above 50° C.,
4. Be able to be ground to form particles between 0.1 μm and 5μm, in diameter,
5. Be able to form a particle (average by area) of less than 10 μm, e.g., determined by Horiba CAPA-500 centrifugal automatic particle analyzer, manufactured by Horiba Instruments, Inc., Irvine, CA: solvent viscosity of 1.24 cps, solvent density of 0.76 g/cc, sample density of 1.32 using a centrifugal rotation of 1,000 rpm, a particle size range of 0.01 to less than 10μm, and a particle size cut of 1.0 μm.
6. Be able to fuse at temperatures in excess of 70° C. By solvation in 3. above, the resins forming the toner particles will become swollen or gelatinous.

Suitable nonpolar liquid soluble ionic or zwitterionic compounds (C), which are used in an amount of 1 to 1000 mg/g, preferably 1 to 100 mg/g developer solids, include: positive charge directors, e.g., sodium dioctylsulfosuccinate (manufactured by American Cyanamid Co.), zirconium octoate and metal soaps such as copper oleate, etc.; negative charge directors, e.g., lecithin, Basic Calcium Petronate ®, Basic Barium Petronate ® oil-soluble petroleum sulfonate, manufactured by Sonneborn Division of Witco Chemical Corp., New York, NY, alkyl succinimide (manufactued by Chevron Chemical Company of California), etc.

The fourth component of the electrostatic liquid developer is at least one aminoalcohol (D), preferably thoroughly dispersed throughout the developer. Examples of this type compound include: triisopropanolamine, triethanolamine, ethanolamine, 3-amino-1-propanol, o-aminophenol, 5-amino-1-petanol, tetra(2-hydroxyethyl)ethylene diamine, etc. The aminoalcohol is used in an amount of 1 to 1000 mg/g, preferably 1 to 100 mg/g developer solids.

Components (A) and (B) are present in the electrostatic liquid developer in the following amounts.

Component (A): 99.9 to 85% by weight, preferably 99.5 to 98% by weight; and

Component (B): 0.1 to 15% by weight, preferably 0.5 to 2% by weight. The amounts of components (C) and (D) in the developer are set out above and are not included in considering weight of developer solids.

As indicated above, additional components that can be present in the electrostatic liquid developer are colorants, such as pigments or dyes and combinations thereof, are preferably present to render the latent image visible, though this need not be done in some applictions. The colorant, e.g., a pigment, may be present in the amount of up to about 60 percent by weight or more based on the weight of the resin. The amount of colorant may vary depending on the use of the developer. Examples of pigments are Monastral ® Blue G (C.I. Pigment Blue 15 C.I. No. 74160), Toluidine Red Y (C.I. Pigment Red 3), Quindo ® Magenta (Pigment Red 122). Indo ® Brilliant Scarlet (Pigment Red 123, C.I. No. 71145), Toluidine Red B (C.I. Pigment Red 3), Watchung ® Red B (C.I. Pigment Red 48), Permanent Rubine F6B13-1731 (Pigment Red 184), Hansa ® Yellow (Pigment Yellow 98), Dalamar ® Yellow (Pigment Yellow 74, C.I. No. 11741), Toluidine Yellow G (C.I. Pigment Yellow 1), Monastral ® Blue B (C.I. Pigment Blue 15), Monastral ® Green B (C.I. Pigment Green 7), Pigment Scarlet (C.I. Pigment Red 60), Auric Brown (C.I. Pigment Brown 6), Monastral ® Green G (Pigment Green 7), Carbon Black, Cabot Mogul L (black pigment C.I. No. 77266) and Stirling NS N 774 (Pigment Black 7, C.I. No. 77266).

Fine particle size oxides, e.g., silica, alumina, titania, etc,; preferably in the order of 0.5 μm or less can be dispersed into the liquefied resin. These oxides can be used alone or in combination with the colorants. Metal particles can also be added.

The percent pigment in the thermoplastic resin is 1% to 60% by weight, preferably 1 to 30% by weight.

The particles in the electrostatic liquid developer have an average by area particle size of less than 10 μm, preferably the average by area particle size is less than 5 μm. The resin particles of the developer may or may not be formed having a plurality of fibers integrally extending therefrom although the formation of fibers extending from the toner particles is preferred. The term "fibers" as used herein means pigmented toner particles formed with fibers, tendrils, tentactles, threadlets, fibrils, ligaments, hairs, bristles, or the like.

The electrostatic liquid developer can be prepared by a variety of processes. For example, into a suitable mixing or blending vessel, e.g., attritor, heated ball mill, heated vibratory mill such as a Sweco Mill manufactured by Sweco Co., Los Angeles, CA, equipped with particulate media for dispersing and grinding, Ross double planetary mixer manufactured by Charles Ross and Son, Hauppauge, NY, etc., are placed the above-described ingredients. Generally the resin, dispersant nonpolar liquid and optional colorant are placed in the vessel prior to starting the dispersing step although after homogenizing the resin and the dispersant nonpolar liquid the colorant can be added. Polar additive can also be present in the vessel, e.g., 1 to 99% based on the weight of polar additive and dispersant nonpolar liquid. The dispersing step is generally accomplished at elevated temperature, i.e., the temperature of ingredients in the vessel being sufficient to plasticize and liquefy the resin but being below that at which the dispersant nonpolar liquid or polar additive, if present, degrades and the resin and/or colorant decomposes. A preferred temperature range is 80° to 120° C. Other temperatures outside this range may be suitable, however, depending on the particular ingredients used. The presence of the irregularly moving particulate media in the vessel is preferred to prepare the dispersion of toner particles. Other stirring means can be used as well, however, to prepare dispersed toner particles of proper size, configuration and morphology. Useful particulate media are particulate materials, e.g., spherical, cylindrical, etc. taken from the class consisting of stainless steel, alumina, ceramic, zirconium, silica, and sillimanite. Carbon steel particulate media is useful when colorants other than black are used. A typical diameter range for the particulate media is in the range of 0.04 to 0.5 inch (1.0 to ~13 mm).

After dispersing the ingredients in the vessel with or without a polar additive present until the desired dispersion is achieved, typically 1 hour with the mixture being fluid, the dispersion is cooled, e.g., in the range of 0° C. to 50° C. Cooling may be accomplished, for example, in the same vessel, such as the attritor, while simultaneously grinding in the presence of additional liquid with particulate media to prevent the formation of a gel or solid mass; without stirring to form a gel or solid mass, followed by shredding the gel or solid mass and grinding, e.g., by means of particulate media in the presence of additional liquid; or with stirring to form a viscous mixture and grinding by means of particulate media in the presence of additional liquid. Additional liquid means dispersant nonpolar liquid, polar liquid or combinations thereof. Cooling is accomplished by means known to those skilled in the art and is not limited to cooling by circulating cold water or a cooling material through an external cooling jacket adjacent the dispersing apparatus or permitting the dispersion to cool to ambient temperature. The resin precipitates out of the dispersant during the cooling. Toner particles of average particle size (by area) of less than 10 μm, as determined by a Horiba CAPA-500 centrifugal particle analyzer described above or other comparable apparatus, are formed by grinding for a relatively short period of time.

After cooling and separating the dispersion of toner particles from the particulate media, if present, by means known to those skilled in the art, it is possible to reduce the concentration of the toner particles in the dispersion, impart an electrostatic charge of predetermined polarity to the toner particles, or a combination of these variations. The concentration of the toner particles in the dispersion is reduced by the addition of additional dispersant nonpolar liquid as described previously above. The dilution is normally conducted to reduce the concentration of toner particles to between 0.1 to 3 percent by weight, preferably 0.5 to 2 weight percent with respect to the dispersant nonpolar liquid. One or more nonpolar liquid soluble ionic or zwitterionic compounds, of the type set out above, can be added to impart a positive or negative charge, as desired. The addition may occur at any time during the process. If a diluting dispersant nonpolar liquid is also added, the ionic or zwitterionic compound can be added prior to, concurrently with, or subsequent thereto. If the aminoalcohol compound has not been previously added in the preparation of the developer, it can be added subsequent to the developer being charged. Preferably the aminoalcohol compound is present during the dispersing step. A preferred mode of the invention is described in Example 10.

INDUSTRIAL APPLICABILITY

The electrostatic liquid developers of this invention demonstrate improved charging qualities such as improved stabilized conductivity over liquid toners containing standard charge directors or other known additives. The developers of this invention are useful in copying, e.g., making office copies of black and white as well as various colors; or color proofing, e.g., a reproduction of an image using the standard colors: yellow, cyan, magenta together with black as desired. In copying and proofing the toner particles are applied to a latent eletrostatic image.

Other uses are envisioned for the electrostatic liquid developers include: digital color proofing, lithographic printing plates, and resists.

EXAMPLES

The following examples wherein the parts and percentages are by weight, illustrate but do not limit the invention. In the examples, the melt indices were determined by ASTM D 1238, Procedure A, the average particle sizes by area were determined by a Horiba CAPA-500 centrifugal particle analyzer as described above, conductivities were measured in picomhos (pmho)/cm at five hertz and low voltage, 5.0 volts, and the densities were measured using a Macbeth densitometer model RD 918. Resolution is expressed in the Examples in line pairs/mm (lp/mm). The aminoalcolhol additive used in the Examples have the following designations:

TIPA = triisopropanolamine, Aldrich Chemical Co., Milwaukee, WI, 95%

TEA = triethanolamine, Aldrich Chemical Co., Milwaukee, WI

EA = ethanolamine, Eastman Kodak, Rochester, New York, 98%

3-AP = 3-amino-1-propanol, Aldrich Chemical Co., Milwaukee, WI, 99% o-APh = o-aminophenol, Aldrich Chemical Co., Milwaukee, WI, 99%

5-AP = 5-amino-1-pentanol, Aldrich Chemical Co., Milwaukee, WI, 97%

EXAMPLE 1

In a Union Process 1-S Attritor, Union Process Company, Akron, Ohio, was placed the following ingredients:

| Ingredient | Amount (g) |
|---|---|
| Copolymer of ethylene (89%) and methacrylic acid (11%), melt index at 190° C. is 100, Acid No. is 66 | 200 |
| Heucophthal Blue G XBT-583D, Heubach, Inc., Newark, NJ | 14 |
| Isopar ®-L. nonpolar liquid having a Kauri-butanol value of 27, Exxon Corporation | 1000 |

The ingredients were heated to 100° C.±10° C. and milled at a rotor speed of 230 rpm with 0.1875 inch (4.76 mm) diameter stainless steel balls for one hour. The attritor was cooled to room temperature while the milling was continued and then 700 grams of Isopar ®-H, nonpolar liquid having a Kauri-butanol value of 27. Exxon Corporation, were added. Milling was continued at a rotor speed of 330 rpm for 24 hours to obtain toner particles with an average size of 1.2 μm by area. The particulate media were removed and the dispersion of toner particles was then diluted to 1.5 percent solids with additional Isopar ®-H. To 1500 grams of the 1.5 percent material was added 40 grams of a 5.5% solution (diluted from 55% with Isopar ®-H) of Basic Barium Petronate ® oil-soluble petroleum sulfonate, Sonneborn Division of Witco Chemical Corp., New York, New York, and the specified amount of additive. Image quality was determined using a Savin 870 copier at standard mode: charging corona set at 6.8 kv and transfer corona set at 8.0 kv using as a carrier sheet Plainwell offset enamel paper, number 3 gloss, 60 lb. test, Plainwell Paper Co., Plainwell, Mi. The extended runs were conducted by running the machine in standard mode except that the paper feed was disconnected and a totally black target was used. The results are shown in Table 1.

TABLE 1

| Additive | Amount[a] | Time[b] | Conductivity | Density | Resolution | Transfer Efficiency |
|---|---|---|---|---|---|---|
| none | — | 0 | 71 | 0.82 | 3 | 94% |
| | | 15 | 24 | 1.17 | 7 | 88% |
| TIPA | 0.5 | 0 | 60 | 1.42 | 10 | 72% |
| | | 15 | 64 | 1.11 | 10 | 72% |
| TEA | 0.1 | 0 | 70 | 1.37 | 9 | 91% |
| | | 15 | 77 | 1.01 | 9 | 94% |
| EA | 0.5 | 0 | 60 | 1.65 | 10 | 94% |
| | | 15 | 80 | 1.17 | 11 | 90% |
| 3-AP | 0.5 | 0 | 50 | 1.38 | 9 | 84% |
| | | 15 | 60 | 1.15 | 11 | 75% |
| o-APh | 0.5 | 0 | 61 | 1.12 | 6 | 92% |
| | | 15 | 61 | 1.22 | 8 | 80% |
| 5-AP | 0.5 | 0 | 64 | 0.96 | 10 | 75% |
| | | 15 | 52 | 0.92 | 6 | 67% |

[a]gram
[b]minutes

EXAMPLE 2

In a Union Process 1-S Attritor, Union Process Company, Akron, Ohio was placed the following ingredients:

| Ingredient | Amount (g) |
|---|---|
| Copolymer of ethylene (89%) and methacrylic acid (11%), melt index at 190° C. is 100, Acid No. is 66 | 200 |
| Monastral ® Blue BT 383D | 22 |
| Isopar ®-L, nonpolar liquid having a Kauri-butanol value of 27, Exxon Corporation | 1000 |

The ingredients were heated to 100° C.±10° C. and milled at a rotor speed of 230 rpm with 0.1875 inch (4.76 mm) diameter stainless steel balls for two hours. The attritor was cooled to room temperature while the milling was continued and then 700 grams of Isopar ®-H, nonpolar liquid having a Kauri-butanol value of 27, Exxon Corporation, was added. Milling was continued at a rotor speed of 330 rpm for three hours to obtain toner particles with an average size of 1.8 μm by area. The particulate media were removed and the dispersion of toner particles was then diluted to 2.0 percent solids with additional Isopar ®-H. A charge director and additive were added as indicated in Table 2. Image quality was determined using a Savin 870 copier as described in Example 1 using the paper described in that Example and Savin 2200 office copier paper (Savin).

TABLE 2

| Sample | Charge Director | Amount[a] | Additive | Amount[b] |
|---|---|---|---|---|
| 2-A | lecithin[c] | 38 | none | — |
| 2-B | lecithin[c] | 38 | TIPA | 42 |
| 2-C | Basic Barium Petronate ® | 92 | none | — |
| 2-D | Basic Barium Petronate ® | 92 | EA | 17 |

[a]mg charge director per gram developer solids
[b]mg additive solids or pure liquid per gram developer solids
[c]purified grade, Fischer Chemical Co. Pittsburgh, PA

TABLE 3

| Sample | Paper | Copy Quality | Density | Resolution | Transfer Efficiency |
|---|---|---|---|---|---|
| 2-A | Ex. 1 | v. poor | 0.4 | 4 | 30% |
| | Savin | v. poor | 0.2 | 4 | 25% |
| 2-B | Ex. 1 | excellent | 2.4 | 10 | 100% |
| | Savin | excellent | 1.4 | 9 | 93% |
| 2-C | Ex. 1 | v. poor | unreadable copy | | 37% |
| | Savin | v. poor | 0.1 | 2 | 10% |
| 2-D | Ex. 1 | poor | 1.1 | 4 | 50% |
| | Savin | poor | 0.4 | 5 | 50% |

EXAMPLE 3

The procedure of Example 2 was repeated except that magenta and scarlet flushed pigment water presscakes were used as pigments instead of the Monastral ® Blue. The pigments were prepared in the following manner. To a Baker-Perkins sigma blade mixer was charged 450 grams of Mobay Quindo Magenta Presscake RV-6831 and 200 grams of mineral oil, intestinal lubricate, E. R. Squibb & Sons, Inc., Princeton, NJ. This was mixed until smooth and then an additional 200 grams of said mineral oil was added and mixed until smooth. The water was then removed by vacuum distillation. This procedure was repeated with Mobay Indofast Brilliant Scarlet Presscake R-6303. To prepare the toner 61.6 grams of the magenta flushed pigment and 10.4 grams of the scarlet flushed pigment were used. Toner with an average particle size of 1.37 μm was obtained. Basic Barium Petronate ® was used as the charge director in the amount of 37 mg per gram of toner solids. The results are shown in Table 4.

TABLE 4

| Additive | Paper | Copy Quality | Density | Resolution | Transfer Efficiency |
|---|---|---|---|---|---|
| none | Ex. 1 | good | 1.3 | 10 | 92% |
| | Savin[a] | fair | 0.8 | 7 | 84% |
| TIPA[b] | Ex. 1 | excellent | 1.3 | 10 | 99% |
| | Savin[a] | good | 1.0 | 9 | 91% |

[a]Savin = Savin 2200 office copier paper
[b]7 mg/g developer solids

EXAMPLE 4

In a Union Process 1-S Attritor, Union Process Company, Akron, Ohio, was placed the following ingredients:

| Ingredient | Amount (g) |
|---|---|
| Copolymer of ethylene (89%) and methacrylic acid (11%), melt index at 190° C. is 100, Acid No. is 66 | 200 |
| Cabot sterling NS black pigment | 15 |
| Isopar ®-L, nonpolar liquid having a Kauri-butanol value of 27, Exxon Corporation | 1000 |

The ingredients were heated to 100° C.±10° C. and milled at a rotor speed of 230 rpm with 0.1875 inch (4.76 mm) diameter stainless steel balls for two hours. The attritor was cooled to room temperature while the milling was continued and then 700 grams of Isopar ®-H, nonpolar liquid having a Kauri-butanol value of 27, Exxon Corporation, were added. Milling was continued at a rotor speed of 330 rpm for 21 hours to obtain toner particles with an average size of 1.4 μm by area. The particulate media were removed and the dispersion of toner particles was then diluted to 1.5 percent solids with additional Isopar ®-H. To 1500 grams of the 1.5 percent material was added 35 grams of Basic Barium Petronate ® described in Example 1 and 0.5 gram of the specified additive. Image quality was determined using a Savin 870 copier as described in Example 1 using the paper indicated. The results are shown in Tables 5 and 6 below.

TABLE 5

| Additive | Paper | Time[b] | Density | Resolution | Transfer Efficiency |
|---|---|---|---|---|---|
| none | Ex. 1 | 0 | 1.82 | 8 | 90% |
| | | 15 | 1.77 | 7 | 65% |
| | Ex. 2[a] | 0 | 1.24 | 9 | 66% |
| | | 25 | 0.77 | 9 | 50% |
| TEA | Ex. 1 | 0 | 1.57 | 10 | 98% |
| | | 15 | 1.37 | 11 | 100% |
| | Ex. 2[a] | 0 | 1.02 | 9 | 90% |
| | | 15 | 0.89 | 10 | 89% |
| EA | Ex. 1 | 0 | 1.72 | 9 | 75% |
| | | 15 | 1.65 | 9 | 70% |
| | Ex. 2[a] | 0 | 0.61 | 9 | 33% |

TABLE 5-continued

| Additive | Paper | Time[b] | Density | Resolution | Transfer Efficiency |
|---|---|---|---|---|---|
| | | 15 | 0.59 | 10 | 33% |

[a]Savin 220 office copier paper
[b]minutes

TABLE 6

| Additive | Conductivity Time = 0 | Time = 5 | Time = 10 | Time = 15 |
|---|---|---|---|---|
| none | 34 | 22 | 14 | 11 |
| TEA | 65 | 74 | 83 | 88 |
| EA | 32 | 36 | 40 | 44 |

[a]minutes

FIG. 1 shows the conductivity of the control developer and developers of the invention containing TEA or EA over a time period of 15 minutes.

EXAMPLE 5

Example 5 demonstrates that mixtures of aminoalcohols are effective in improving image quality and stabliizing developer conductivity during extended imaging runs. Developers were prepared, charged, and tested as in Example 1. In Sample 5-A the additives used were 0.25 gram TIPA plus 0.05 gram TEA. In Sample 5-B the additives were 0.25 gram TIPA plus 0.25 gram 3-AP. The results are shown in Table 7.

TABLE 7

| Sample | Time[a] | Conductivity | Density | Resolution[a] | Transfer Efficiency |
|---|---|---|---|---|---|
| 5-A | 0 | 70 | 1.07 | 11 | 72% |
| | 15 | 60 | 0.85 | 11 | 69% |
| 5-B | 0 | 90 | 0.97 | 10 | 74% |
| | 15 | 120 | 0.88 | 11 | 81% |

[a]minutes

EXAMPLE 6

Example 6 demonstrates the effect of additive concentration on conductivity.

In a Union Process 1-S Attritor, Union Process Company, Akron, Ohio, was placed the following ingredients:

| Ingredient | Amount (g) |
|---|---|
| Copolymer of ethylene (89%) and methacrylic acid (11%), melt index at 190° C. is 100, Acid No. is 66 | 200 |
| Mobay RV-6803, magenta pigment | 22 |
| Isopar ®-L, nonpolar liquid having a Kauri-butanol value of 27, Exxon Corporation | 1000 |

Figure 2:
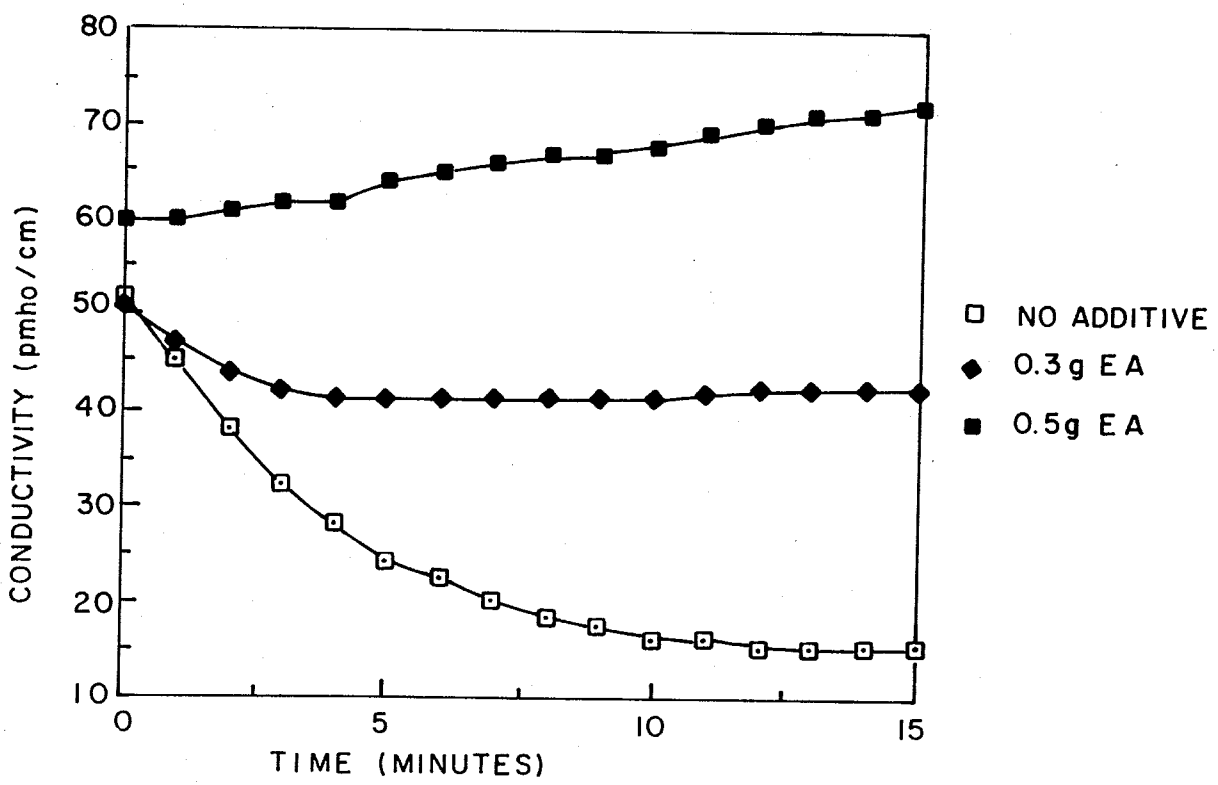
FIG. 2 is a plot of the conductivity (pmho/cm) during a machine run over a time period of 15 minutes (Example 6) of a control developer (no additive) and two developers of the invention containing ethanolamine (EA) in amounts of 0.3g and 0.5g.

The ingredients were heated to 100° C.±10° C. and milled at a rotor speed of 230 rpm with 0.1875 inch (4.76 mm) diameter stainless steel balls for two hours. The attritor was cooled to room temperature while the milling was continued and then 700 grams of Isopar ®-H, nonpolar liquid having a Kauri-butanol value of 27, Exxon Corporation, were added. Milling was continued at a rotor speed of 330 rpm for 22 hours to obtain toner particles with an average size of 0.9 μm by area. The particulate media were removed and the dispersion of toner particles was then diluted to 1.5 percent solids with additional Isopar ®-H. To 1500 grams of the 1.5 percent material was added 40 grams of a 5.5% solution of Basic Barium Petronate ® described in Example 1 and the specified amount of EA. Image quality was determined using a Savin 870 copier at standard mode as described in Example 1 using the paper described in that Example. The extended run was conducted by running the machine in standard mode with a black target and the paper feed disconnected. The results are shown in Table 8 below and in FIG. 2 which shows the conductivity of the developers over a time period of 15 minutes.

TABLE 8

| EA (g) | Time[a] | Conductivity | Density | Resolution | Transfer Efficiency |
|---|---|---|---|---|---|
| none | 0 | 52 | 1.57 | 9 | 85% |
| | 15 | 15 | 2.01 | 7 | 70% |
| 0.3 | 0 | 51 | 1.41 | 10 | 84% |
| | 15 | 42 | 1.45 | 9 | 80% |
| 0.5 | 0 | 60 | 1.28 | 10 | 80% |
| | 15 | 72 | 1.15 | 11 | 75% |

[a]minutes

EXAMPLE 7

This example compares the effect of an alcohol amine with the effect of the combination of an amine and an alcohol. The procedure in Example 6 was repeated except that the average particle size of the toner was 1.8 μm. The additives used are shown in the Table 9 below.

TABLE 9

| Additive | Amount[c] | Time[d] | Conductivity | Density | Resolution |
|---|---|---|---|---|---|
| none | — | 0 | 74 | unreadable | |
| | | 15 | 20 | 0.40 | 10 |
| HAl[a] | 0.5 | 0 | 27 | unreadable | |
| | | 15 | 8 | unreadable | |
| HAm[b] | 0.5 | 0 | 70 | unreadable | |
| | | 15 | 20 | unreadable | |
| HAl[a] + | 0.25 | 0 | 32 | unreadable | |
| HAm[b] | 0.25 | 15 | 14 | unreadable | |
| 5-AP | 0.6 | 0 | 42 | 1.56 | 10 |
| | | 15 | 38 | 1.50 | 10 |

[a]HAl = 1-hexanol, purified grade, J. T. Baker, Phillipsburg, NJ
[b]HAm = 1-hexylamine, Aldrich Chemical Co., Milwaukee, WI
[c]grams
[d]minutes

EXAMPLE 8

This example demonstrates that tetra(1-hydroxyethyl)ethylenediamine (THEEDA), Pfaltz and Bauer, Inc., Waterbury, Ct, improved image quality but appears to have no beneficial effect on toner stability during extended imaging runs[1]. Toner was prepared as described in Example 6 except that the average particle size is 0.94 μm. The toner, 1500 g of 1.5% toner, was charged with 40 g 5.5% Basic Barium Petronate ® described in Example 1 and 0.5 g additive and was evaluated in a Savin 870 copier as described in Example 1. The results are shown in Table 10 below.

TABLE 10

| | Image Quality Time = 0 | | | | Time = 15 minutes | | | |
|---|---|---|---|---|---|---|---|---|
| Additive | Conductivity | Density | Resolution | Transfer Efficiency | Conductivity | Density | Resolution | Transfer Efficiency |
| None | 68 | | unreadable | | 20 | | unreadable | |
| THEEDA | 78 | 1.03 | 6 | 100% | 24 | 0.74 | 6 | 79% |

1. The extended run was conducted by running the machine in standard mode as described in Example 1 except that the paper feed was disconnected and a totally black target was used.

EXAMPLE 9

Developer was prepared in the following fashion: 7.0 g cyan pigment (Heubach, Heucophthal Blue G XBT-583D) is dispersed in 100 g polystyrene (Polysciences Polystyrene Ultrafine powder, CAT #15790) using a 2-roll mill. 40 g of this dispersion is added to a Union Process 0-1 attritor with 125 g Isopar ®-H and 125 g Isopar ®-L and ground with 0.1875 inch (4.76 mm) diameter stainless steel balls for 5 days to obtain a toner with average particle size of 1.2 μm. The toner was charged with lecithin to a level of 35 mg lecithin per gram developer solids. This developer was tested; 0.5 g TEA was added and the developer was retested. The results are shown in Table 11 below.

TABLE 11

| | Image Quality Time = 0 | | | Time = 15 minutes | | |
|---|---|---|---|---|---|---|
| Additive | Conductivity | Density | Resolution | Conductivity | Density | Resolution |
| None | 44 | 1.82 | 5 | 26 | 1.11 | 6 |
| TEA | 42 | 1.09 | 5 | 39 | 0.87 | 5 |

EXAMPLE 10

To a Union Process 1-S Attritor charged with 0.1875 (4.76 mm) carbon steel balls was added 200 g resin, 43.3 g magenta pigment (Mobay RV-6803), 23.3 g scarlet pigment (Mobay R-6300) and 1000 g Isopar ®-L. This mixture was milled at 100° C. for two hours then the Attritor was cooled with recirculating water and 700 g of Isopar ®-H and 10 g TIPA were added. The mixture was milled for 20 hours to give toner with average particle sizes ranging from 1.3 μm. The toner was diluted to 2.0% solids and to 2000 grams of this dispersion was added 60 g of 5.5% solution (diluted from 55% with Isopar ®-H) of Basic Barium Petronate ®. The toner was evaluated during extended imaging runs in a Savin 870 office copier run at standard mode as described in Example 8 using offset enamel paper as described in Example 1.

| | Image Quality Time = 0 | | | Time = 15 minutes | | |
|---|---|---|---|---|---|---|
| Conductivity | Density | Resolution | Transfer Efficiency | Conductivity | Density | Resolution | Transfer Efficiency |
| 49 | 1.79 | 6 | 99% | 55 | 1.54 | 8 | 91% |

I claim:

1. An electrostatic liquid developer having improved charging characteristics consisting essentially of:

(A) nonpolar liquid having a Kauri-butanol value of less than 30, present in a major amount, (B) thermoplastic resin particles having an average by area particle size of less than 10 μm, (C) nonpolar liquid soluble ionic or zwitterionic compound, and (D) at least one aminoalcohol compound.

2. An electrostatic liquid developer according to claim 1 wherein the aminoalcohol is triisopropanolamine.

3. An electrostatic liquid developer according to claim 1 wherein the aminoalcohols are mixture of triisopropanolamine and triethanolamine.

4. An electrostatic liquid developer according to claim 1 wherein component (A) is present in 99.9 to 85% by weight, component (B) is present in 0.1 to 15% by weight, based on the total weight of the developer, component (C) is present in an amount of 1 to 1000 mg/g developer solids, and component (D) is present in an amount of 1 to 1000 mg/g developer solids.

5. An electrostatic liquid developer according to claim 1 containing up to about 60% by weight of a colorant based on the weight of resin.

6. An electrostatic liquid developer according to claim 5 wherein the colorant is a pigment.

7. An electrostatic liquid developer according to claim 6 wherein the percent pigment in the thermoplastic resin is 1% to 60% by weight based on the weight of resin.

8. An electrostatic liquid developer according to claim 5 wherein the colorant is a dye.

9. An electrostatic liquid developer according to claim 1 wherein a fine particle size oxide is present.

10. An electrostatic liquid developer according to claim 1 wherein the thermoplastic resin is a copolymer of ethylene and an $\alpha,\beta$-ethylenically unsaturated acid selected from the group consisting of acrylic acid and methacrylic acid.

11. An electrostatic liquid developer according to claim 1 wherein the thermoplastic resin is a copolymer of ethylene (80 to 99.9%)/acrylic or methacrylic acid (20 to 0%)/alkyl ester of acrylic or methacrylic acid wherein alkyl is 1 to 5 carbon atoms (0 to 20%).

12. An electrostatic liquid developer according to claim 10 wherein the thermoplastic resin is a copolymer of ethylene (89%)/methacrylic acid (11%) having a melt index at 190° C. of 100.

13. An electrostatic liquid developer according to claim 1 wherein the particles have an average by area particle size of less than 5 μm.

14. An electrostatic liquid developer having improved charging characteristics comprising:

(A) nonpolar liquid having a Kauri-butanol value of less than 30, present in a major amount.

(B) thermoplastic resin particles having an average by area particle size of less than 10 mm, (C) Basic Barium Petronate, and (D) at least one aminoalcohol compound.

15. An electrostatic liquid developer having improved charging characteristics comprising:

(A) nonpolar liquid having a Kauri-butanol value of less than 30, present in a major amount, (B) thermoplastic resin particles having an average by area particle size of less than 10mm, (C) lecithin, and (D) at least one aminoalcohol compound.

16. An electrostatic liquid developer according to claim 1 wherein the amino alcohol is triethanolamine.

* * * * *